United States Patent [19]

Décombe et al.

[11] 4,076,495

[45] Feb. 28, 1978

[54] SULPHURIZED PAPER SUPPORTS

[75] Inventors: Robert Décombe, Ferney-Voltaire; Bernard Hugelin, Gaillard, both of France

[73] Assignee: Sublistatic Holding SA, Glaris, Switzerland

[21] Appl. No.: 671,703

[22] Filed: Mar. 29, 1976

Related U.S. Application Data

[63] Continuation of Ser. No. 486,836, Jul. 9, 1974, abandoned.

[51] Int. Cl.[2] ..... D06P 5/20

[52] U.S. Cl. ..... 8/2.5 A; 8/2.5 R; 101/470; 106/22; 427/146; 428/537; 428/913

[58] Field of Search ..... 428/918, 537; 427/146; 8/2.5 A, 2.5 R; 101/470

[56] References Cited

U.S. PATENT DOCUMENTS

| | | | |
|---|---|---|---|
| 3,922,445 | 11/1975 | Mizuno et al. | 428/467 |
| 3,969,071 | 7/1976 | Hugelin | 8/2.5 R |

*Primary Examiner*—Stanford M. Levin

*Attorney, Agent, or Firm*—Wenderoth, Lind & Ponack

[57] ABSTRACT

Temporary carriers which can be used in the thermoprinting technique, and particularly in thermoprinting textiles by transfer, characterized in that they comprise a print which is generally multicolored and which is produced from an alkalizing agent and one or more cationic dyestuffs, which, at atmospheric pressure, pass into the vapor state at temperature above 160° C, the said print being carried by a sheet or strip of sulphurized paper.

9 Claims, No Drawings

SULPHURIZED PAPER SUPPORTS

The present application is a continuation of application Ser. No. 486,836, filed July 9, 1974, now abandoned.

It is known that it is possible to print textiles and other flat surfaces made of synthetic materials by hot transfer of the pattern or design previously printed on an intermediate carrier generally made of paper, optionally backed with aluminium foil (see French Pat. No. 1,223,330).

If aqueous inks are used for printing the intermediate carrier, a certain number of problems which are difficult to solve arise for the person printing the paper. This is why intermediate paper carriers which have been prepared by means of solvent-based inks are preferably used in the known thermoprinting processes. Whilst the process which involves the aqueous method gives intermediate carriers which are frequently sticky and sensitive to moisture, even just to the dampness of the hands of the personnel who handle them, the process using solvent-based inks described in French Pat. No. 1,585,119 provides carriers which are not sticky and are insensitive to moisture and which thus do not tend to undergo deterioration even when they are stored for a long time in a humid atmosphere. These carriers nevertheless possess the disadvantage of not adhering to the material onto which the pattern is to be transferred, when they are brought into contact at the transfer temperature, so that certain defects, such as fuzziness of the lines of the design, can arise from this lack of adhesion of the carriers. It was thus necessary to resort to overlacquering coloured prints with a substance which promotes the adhesion of the carrier to the textile. During the winding up process, the overlacquering also prevents dyestuffs from staining on the reverse side of the paper, which, in consideration of the porosity of the latter, leads to stains on the final carrier during transfer. Despite these advantages, the overlacquering of papers used in thermoprinting nevertheless possesses a certain number of disadvantages: Thus, for example, it is more difficult, once the transfer is complete, to separate the textile material from the temporary carrier; furthermore, part of the product used for the overlacquering is deposited on the carrier of the textile, thus altering its appearance and even its handle.

The present invention relates to new temporary carriers which, when used in the abovementioned dry thermoprinting technique, enable the process to be carried out more satisfactorily and, in general terms, give better results than the carriers known hitherto. The carriers of the present invention are characterised in that they possess, like the known carriers, a pattern which is generally coloured, printed by means of one or more substances, such as flameproofing agents, antistatic agents, softeners and preferably dyestuffs or optical bluing agents, all of which can sublime or vaporise at temperatures ranging between 160 and 220° C at atmospheric pressure, but that, in contrast to the known carriers, they carry the printed pattern not on an ordinary paper or on layered paper but on a so-called sulphurised paper.

By the actual name of sulphurised paper (which is also called vegetable parchment) there is to be understood a sheet of cellulose which has been subjected to the action of concentrated sulphuric acid. Destruction of the cellulose-acid thus formed, by repeated washings with water, regenerates a cellulose cured to a greater or less depth.

In principle, the preparation of the actual sulphurised paper is carried out in two stages: (1) A non-sized paper of the blotting paper type is manufactured from pulp made from old cotton rags or from bleached wood pulp. This first stage of the manufacturing process is not substantially different from that of ordinary paper. In a second stage, the blotting paper obtained, which possesses a high porosity, passes through a bath of sulphuric acid of concentration between 52° and 60° B. The period of immersion depends on the desired result, on the thickness of the paper, on its nature and on its porosity. The concentrated sulphuric acid can act at the surface or right through but it must not cause degradation of the cellulose. The sulphurisation bath is usually constantly cooled. Passing the sheet of blotting paper through sulphuric acid causes a shrinkage which is the greater, the heavier is the weight of a given area of the paper and the deeper is the action of the acid. Pulps formed by means of sodium hydroxide solution undergo sulphurisation better than do pulps formed by means of bisulphite.

After they have passed through the sulphuric acid, the sheets of sulphurised paper are drained and then pass through tanks in which water flows, until complete washing has been effected in order to remove all traces of acidity from the paper. The first washing tanks are generally cooled to a very great extent in order to prevent the heat produced by dilution of sulphuric acid from promoting hydrolysis of the cellulose of the paper.

After complete washing, the sheet is drained and then, as a general rule, it is subjected to a finishing treatment which causes it, after drying, to retain sufficient flexibility. Drying is usually carried out by passing the sheet over polished rollers which are steam-heated and against which the sheet of vegetable parchment is held by thick felts made of wool or some other material which is insensitive to heat; these felts absorb the steam which is evolved from the sheet and hold the latter tightly against the drying roller in order to limit its shrinkage as much as possible.

The nature of the finishes which can be applied to the sulphurised papers varies greatly. They can be formed from hygroscopic alkalino-ferrous chlorides mixed with glycerine, glucose or dextrins. The sheets can be coated with an impermeable layer based on nitrocellulose. The vegetable parchment thus obtained is, in the dry state, an odourless and insoluble material which is very resistant to water and to fatty materials.

In addition to the actual sulphurised papers, those which contain 20 to 25% of hemi-cellulose and which have been treated mechanically in order to make the fibre transparent, and finally the papers called Opaline which are opaque (they generally contain titanium oxide) are also used in the present invention.

In order to prepare the temporary carriers of the present invention, the sulphurised papers are printed in a manner which is in itself known (see, for example, French Pat. Nos. 1,223,330, 1,585,119 and 7,101,347).

If the photogravure technique is used, one or more engraved rollers deposit ink on the carrier made of sulphurised paper at the desired places which are determined by the nature of the pattern to be transferred. The latter is printed on the temporary carrier as in the known processes, for example by applying anhydrous inks, that is to say by means of varnishes, emulsions or dispersions which are completely or almost completely free from water and which contain, in the dissolved state, or, better in the very finely dispersed state, a disperse dyestuff which, at atmospheric pressure, passes into the vapour state at temperatures above 160° and even better 180° C, an anhydrous or almost anhydrous organic solvent and a heat-resistant binder or thickener. The only difference between the process according to the invention and the known process thus consists of using a sulphurised paper, and preferably a sulphurised paper weighing less than 60 grams per square meter, as the carrier for the print.

By dyestuff which passes into the vapour state at temperatures above 160° C, there are to be understood in this context, as in the known process, dyestuffs from various categories, for example disperse dyestuffs or cationic dyestuffs, the molecular weight of which varies between 250 and 600.

These dyestuffs can be, for example, of the azo or anthraquinone series, and even vat dyestuffs, quinophthalone derivatives, nitro-arylamines and the like. Special mention will be given to the following dyestuffs, the characteristic of which is that they have rather similar sublimation curves and this enables them to be used together: 1,4-Dimethyl- or 1,4-diisopropylaminoanthraquinone, brominated or chlorinated 1,5-diamino-4,8-dihydroxyanthraquinone, hydroxyquinophthalone, 1-hydroxy-3-phenoxy-4-aminoanthraquinone, 1-amino-2-cyano-4-anilidoanthraquinone and 1-amino-2-cyano-4-cyclohexylaminoanthraquinone, as well as the dyestuffs which behave in a very similar manner to the above at 180°–210° C, for example the methyl, ethyl, propyl or butyl esters of 1,4-diaminoanthraquinone-2-carboxylic acid, 1-amino-2-chloro-4-hydroxyanthraquinone and the like.

As examples of cationic dyestuffs, the following substances may be mentioned: Malachite Green, so-called Döbner Violet, oxazines and thiazines like those of the formula:

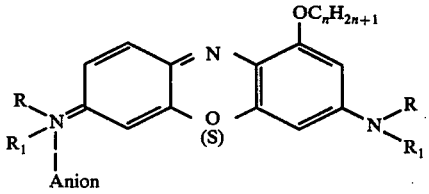

(n=1 or 2)
(R and R$_1$ =methyl or ethyl)

The yellow dyestuff of the formula:

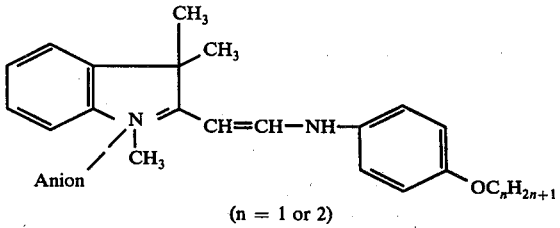

(n = 1 or 2)

and triphenylmethanes like those of the formula:

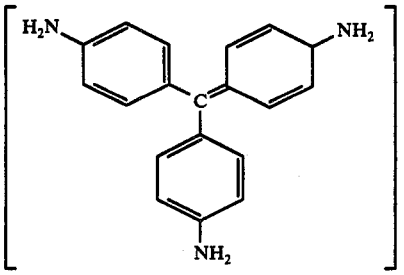

or

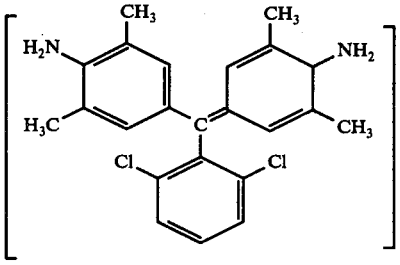

When cationic dyestuffs are used, it is generally advantageous, especially in the case of dyestuffs which do not sublime or vaporise readily, to add an alkalizing agent to the ink used to print the paper; the alkalizing agent can also be deposited in an undercoat. When it is necessary to add such an agent, it is advantageous to add it in amounts which are at least stoichiometric so that, during transfer, all the anion of the dyestuff is bonded by the alkalizing agent, taking into account possible acidity of the paper.

As in the usual process, in order to prepare the inks intended to form the print or the pattern to be transferred from the new carriers according to the invention, practically anhydrous organic solvents are used, such as solvents or mixtures of solvents which may or may not be miscible with water and the boiling point of which, at atmospheric pressure, is below 120° C and preferably below 105° C. These solvents must contain less than 10% of water. By way of examples of such solvents, the following compounds may be mentioned: Halogenated or non-halogenated hydrocarbons, of the aliphatic or aromatic series, such as toluene, cyclohexane, heptane and petroleum ether, as well as alcohols of low molecular weight, such as methanol, ethyl alcohol, propyl alcohol and isopropyl alcohol, esters of aliphatic acids such as ethyl acetate, methyl propionate and ethyl propionate, ketones such as methyl ethyl ketone, and the like.

The binders (or thickeners) which are resistant to heat, that is to say which do not undergo change at the temperature at which the transfer takes place or in which the change, in the case where they do undergo change, does not have an effect on the pattern to be transferred and on the subsequent separation of the temporary carrier from the material on which the thermoprinting has been carried out, are available commercially and are widely used for the direct printing of textile materials, but it is advisable to choose them from amongst those which have a low solids content.

It must be possible to dry them to give a film which is as non-sticky as possible and which retains the dyestuff or dyestuffs used on the paper, but which does not oppose the passage of the dyestuffs from the temporary carrier to the textile material to which it is intended to apply them. Binders which are inert or which decompose to a relatively small extent or not at all under the influence of heat, and which restrict themselves to holding the vaporisable materials used without changing them are preferably used. By way of example, those which can be dried, for example in a stream of hot air, so as to form a skin or a film on the sheet of the printed carrier may be mentioned, for example nitrocelluloses or maleinates, for example colophony maleinates. As binders which are very particularly suitable, cellulosic esters and especially cellulosic ethers may be mentioned, such as cellulosic ethers of an alcohol with a low molecular weight like ethyl-cellulose, propyl-cellulose and even benzyl-cellulose, as well as their mixtures, and very especially hydroxypropylcellulose and mixtures of cellulosic ethers containing ethylcellulose, and mixtures of cellulosic ethers containing hydroxypropyl-cellulose and even acetyl-cellulose, and cellulose acetobutyrates or acetopropionates.

Apart from the use of anhydrous or almost anhydrous inks and suitable binders, the temporary carriers of the present invention are prepared in accordance with the usual techniques, as indicated above. Thus a carrier can be printed locally or overall; the printing can be carried out on the photogravure machines usually employed for this type of work or on machines which are used in offset techniques and in flexography, and even on printing machines with a flat or rotating frame.

Like the known carriers, the new temporary carriers based on sulphurised paper produced according to the present invention make it possible to dye or to print synthetic materials. This dyeing or printing, which is a further subject of the present invention, consists of bringing the temporary carrier, printed as has just been described, into contact, at least locally, with the material to be dyed which is preferably heated, during this period of contact, to a temperature of the same order of magnitude as that at which the dyestuffs pass into the vapour state, so that the latter do not simply condense at the surface. The dyeing (printing) is thus reduced to a pass over a heated plate or calender or any other apparatus which makes it possible to bring the temporary carrier and the material to be dyed into contact and to heat them to the required temperature for the period of time necessary for the dyestuffs to be transferred and to penetrate into the material to be dyed.

No subsequent washing or vaporising treatment is necessary in order to fix the dyestuff or to prevent it from being discharged subsequently.

The new carriers of the present invention are suitable for dyeing synthetic materials such as superpolyamides (polymer of ϵ-caprolactam or of the hexamethylene-diamide of adipic acid), polyesters and especially linear polyesters such as polyethylene terephthalates, polyacrylonitrile and the like. The materials to be dyed can be in the most diverse forms, for example in the form of sheets, a film or a felt, and as a textile in the form of staple fibre, a yarn, a carpet, a knitted fabric, non-woven fabrics, a web or woven fabrics of varying thickness, in the pure state or mixed, for example, with cotton or wool.

In the following non-limiting examples, the parts and percentages given are expressed by weight, unless otherwise indicated, and the temperatures are expressed in degrees centigrade.

EXAMPLE 1

Printing of a multicoloured design on one face of a woven fabric made of "Tergal" (ethylene terephthalate polymer)

The following procedure is used to prepare three inks:

(a) Yellow ink 6 parts of hydroxyquinophthalone together with 6 parts of ethyl-cellulose N 7 are dispersed in 88 parts of ethyl alcohol.
(b) Red ink 6 parts of 1-amino-2-phenoxy-4-hydroxyanthraquinone together with 6 parts of ethyl-cellulose are dispersed in 88 parts of ethyl alcohol.
(c) Blue ink 6 parts of 1-amino-2-cyano-4-anilidoanthraquinone together with 6 parts of ethyl-cellulose are dispersed in 88 parts of ethyl alcohol.

Using these inks and several inking rollers, one face of a sulphurised paper, weighing 31 grams per square meter, is printed so as to produce a multicoloured design, in accordance with the printing technique usually employed in photogravure.

The face of the strip of sulphurised paper printed in this way is brought into contact with a woven fabric made of a polymer of ethylene terephthalate, and the whole is passed over a metal plate heated electrically to 200° C; a second non-heated plate provides uniform contact. The period of contact under hot conditions is 45 seconds. A faithful transfer of the design previously printed on the sulphurised paper is thus obtained on the woven fabric; the lines of the design remain perfectly sharp.

Instead of a woven fabric made of ethylene terephthalate polymer, it is also possible to use a woven fabric made of polyamide (polyhexamethylene-diamine adipate or ϵ-caprolactam polymer), a mixed wool/polyamide woven fabric or a cotton/ethylene terephthalate woven fabric or a polyacrylonitrile woven fabric, and excellent results are also obtained.

It is also possible to work continuously, by heating to a higher temperature and by adjusting the speeds of the printed paper and of the woven fabric to be dyed, so that they remain in contact, for example, for 20 seconds at 210° C.

EXAMPLE 2

The procedure of Example 1 is followed, but a strip of sulphurised paper, the weight of which is approximately 55 g per $m^2$, is used. Temporary carriers are thus produced which, when heated in contact with a woven fabric made of polyethylene terephthalate, also give prints with sharp lines. Even without overlacquering, the sulphurised paper which has been printed can be wound up on itself without dyestuff stains which may be present on the reverse side of the paper staining the material to be printed, during the transfer process.

EXAMPLE 3

A 7% strength solution of ethyl-cellulose E7 (Dow Chemicals) in ethyl alcohol containing 50 g/l of sodium methylate is coated, at the rate of 24 g per square meter, onto a sulphurised paper weighing 37 g per $m^2$.

After drying, the paper is coated with a solution consisting of 50 g of Malachite Green per liter of ethyl alcohol, this solution being thickened with 7% of ethyl-cellulose. After drying, the paper thus obtained is brought into contact for 35 seconds with a woven fabric made of ORLON 42 in a press heated to 190° C. As a result of this, the woven fabric is printed well in a brilliant green which is resistant to resublimation.

Instead of sodium methylate, it is possible to use a corresponding amount of sodium hydroxide.

In order to obtain a red print, it is sufficient to replace the Malachite Green with ASTRAZON RED Violet 3R supplied by Messrs. Bayer.

Using ASTRAZON Orange G supplied by the same company, orange prints are obtained by means of the same technique, whilst by using Blue MAXILON 5G supplied by Messrs. CIBA-GEIGY, fast blue prints are obtained on ORLON 42 and on woven fabrics made of polyester fibres modified with acids (DACRON 64).

EXAMPLE 4

A *blue ink* is prepared in the following way:

The dyestuff SEVRON BLUE ER which is supplied by Messrs. Du Pont and which is not broken up into powder form (2 parts) is introduced into industrial ethyl alcohol (77 parts) with vigorous stirring.

When the dyestuff is dissolved or finely dispersed, 5 parts of ethyl-cellulose N 22 are added, whilst continuing to stir, followed by 20 parts of a 10% strength by weight alcoholic solution of sodium hydroxide.

A *red ink* is prepared by following the same procedure and replacing the 2 parts of SEVRON BLUE ER by the corresponding amount of ASTRAZON BRILLIANT RED 4G supplied by Messrs. Bayer.

Likewise, a *yellow ink* is prepared by replacing the SEVRON BLUE ER by the corresponding amount of MAXILON GELB 5 GL supplied by Messrs. CIBA-GEIGY.

The inks thus prepared are printed on a sulphurised paper weighing 35 g per square meter, so as to produce a multicoloured design in accordance with the usual photogravure technique.

The face of the paper, printed in this way, is applied to a woven fabric made of polyacrylonitrile, and the whole is heated for 35 seconds at 200° C. The print obtained is sharp, the colours are bright and brilliant and the fastness to washing and the resistance to resublimation are good.

Instead of an acrylic fabric, it is possible to use a woven fabric made of polyamide or of polyester modified with acids (DACRON 64), or a mordanted cotton fabric, on which equally good results are obtained.

When corresponding amounts of one of the following dyestuffs are used instead of the dyestuffs indicated above, satisfactory prints are obtained:

within the range of *blue dyestuffs:*

| | |
|---|---|
| MAXILON BLUE | 5G |
| SEVRON BLUE | 4G |

-continued

| | |
|---|---|
| SANDOCRYL BRILLIANT BLUE | B-BLE |
| ASTRAZON BLUE | G |
| ASTRAZON BLUE | 3GL |
| ASTRAZON BLUE | FL |
| ASTRAZON BLUE | FRR |

within the range of *red dyestuffs:*

| | |
|---|---|
| DIACRYL BRILLIANT PINK | RN |
| DIACRYL BRILLIANT RED | 3G-N |
| DIACRYL RED | MS-N |
| ASTRAZON RED VIOLET | 3R |
| ASTRAZON BRILLIANT RED | 4G |
| ASTRAZON RED | 6B |

within the range of *yellow dyestuffs:*

| | |
|---|---|
| MAXILON YELLOW | 5GL |
| ASTRAZON YELLOW | 3GL |
| ASTRAZON GOLDEN YELLOW | GL |
| ASTRAZON GOLDEN YELLOW | RR |

This list does not in any way imply a limitation.

We claim:

1. In a temporary carrier for use in thermoprinting textiles by transfer of vapors of at least one dyestuff vaporizing at atmospheric pressure at a temperature of above 160° C which carrier comprises a sheet or strip material containing on a face thereof a print, said print containing at least one dyestuff which, at atmospheric pressure, passes into the vapor state at a temperature above 160° C, the improvement wherein the sheet or strip material is vegetable parchment and the print contains at least one cationic dyestuff and an alkalizing agent in a single printed layer.

2. A temporary carrier according to claim 1, wherein the printed layer comprises a multicolored print.

3. A temporary carrier according to claim 2, wherein the vegetable parchment, before printing, weighs less than 60 grams per $m^2$.

4. A temporary carrier according to claim 2, wherein the vegetable parchment weighs between 20 and 50 grams per $m^2$.

5. A temporary carrier according to claim 2, wherein the printed layer is produced from an ink which contains less than 10% water.

6. A temporary carrier according to claim 1, wherein the printed layer consists essentially of an alkali metal or alkaline earth metal hydroxide, a cationic dyestuff and a binder.

7. A temporary carrier according to claim 6, wherein the cationic dyestuff is of the triphenyl methane series.

8. A temporary carrier according to claim 7, wherein the dyestuff vaporizes at atmospheric pressure at a temperature of between 160° and 200° C.

9. A temporary carrier according to claim 8, wherein the binder is a cellulose ether binder.

* * * * *